US009441482B2

(12) United States Patent
Hall et al.

(10) Patent No.: US 9,441,482 B2
(45) Date of Patent: Sep. 13, 2016

(54) HAMMER ELEMENT ON A DEGRADATION PICK

(71) Applicant: David R. Hall, Provo, UT (US)

(72) Inventors: David R. Hall, Provo, UT (US); Francis E. Leany, Salem, UT (US)

(73) Assignee: NOVATEK IP, LLC, Provo, UT (US)

( * ) Notice: Subject to any disclaimer, the term of this patent is extended or adjusted under 35 U.S.C. 154(b) by 0 days.

(21) Appl. No.: 14/168,398

(22) Filed: Jan. 30, 2014

(65) Prior Publication Data

US 2015/0211364 A1 Jul. 30, 2015

Related U.S. Application Data

(60) Provisional application No. 61/758,361, filed on Jan. 30, 2013.

(51) Int. Cl.

| | |
|---|---|
| ***E21C 35/18*** | (2006.01) |
| ***E21C 35/183*** | (2006.01) |
| ***B28D 1/18*** | (2006.01) |

(52) U.S. Cl.

CPC ..... *E21C 35/18* (2013.01); *B28D 1/186* (2013.01); *E21C 35/183* (2013.01)

(58) Field of Classification Search

CPC ..... E21C 35/18; E21C 35/183; E21C 35/19; E21C 2035/1803; E21C 2035/1816

USPC ..... 299/79.1, 100–113

See application file for complete search history.

(56) References Cited

U.S. PATENT DOCUMENTS

| | | | | |
|---|---|---|---|---|
| 4,682,987 | A | 7/1987 | Brady et al. | |
| 4,725,098 | A | 2/1988 | Beach | |
| 6,220,671 | B1 * | 4/2001 | Montgomery, Jr. | 299/102 |
| 7,300,115 | B2 | 11/2007 | Holl et al. | |

FOREIGN PATENT DOCUMENTS

| | | | |
|---|---|---|---|
| DE | 102004044897 | * | 6/2006 |
| EP | 2053198 A1 | * | 4/2009 |

* cited by examiner

*Primary Examiner* — Sunil Singh

(57) ABSTRACT

A body of a degradation pick may comprise a substantially conical frustum. A hammer element may be integrally formed with the substantially conical frustum and extend there from in one radial direction. A shank may protrude from the body opposite a narrow end of the substantially conical frustum.

14 Claims, 3 Drawing Sheets

HAMMER ELEMENT ON A DEGRADATION PICK

CROSS REFERENCE TO RELATED APPLICATIONS

This patent application claims priority to U.S. Provisional Pat. App. No. 61/758,361 which is incorporated herein by reference for all that it contains.

BACKGROUND OF THE INVENTION

The present invention relates generally to the degradation of natural and man-made surfaces as is common in such fields as road milling, mining and construction. More particularly, the present invention relates to increasing the wear resistance of degradation picks commonly used in such processes. In road milling, for example, degradation picks may be secured to the exterior of a rotating drum and brought into engagement with a road surface to remove a layer of the surface in preparation for applying a new layer. In another example, degradation picks may be secured to links of a chain and brought into engagement with the wall of a mine to remove earthen materials. Such uses can wear down a degradation pick quickly.

Degradation picks often comprise a steel body comprising an attachment shank at one end and a super hard tip at an opposing end. As the steel body wears it may fail prior to the super hard tip, prematurely ending the life of the pick. Increasing the wear resistance of degradation picks may extend the life of such picks and thus reduce the frequency that such picks need to be replaced during operation.

Wear to the steel body is especially pronounced on surfaces facing a direction of impact. For example, degradation picks secured to the exterior of a rotating drum may tend to wear on surfaces facing the direction of rotation since these surfaces are most likely to impact a surface.

Consequently, numerous attempts have been made to increase the wear resistance of degradation picks.

One such system is disclosed in U.S. Pat. No. 4,682,987 to Brady et al. which shows heavy duty industrial, mining and general purpose cutting tools comprising hard surface coatings comprising nickel-chromium metal alloy powder and a flux, usually boron and/or silicon. The hard surface is applied in slurry form, dried and then fused in a furnace.

Another such system is disclosed by U.S. Pat. No. 4,725,098 to Beach, which describes a rotary cutting bit for use in mining and excavating applications incorporating an annular groove about a head portion of the bit immediately rearwardly of where a hard tip of the bit is seated and a hardfacing material deposited in the groove in the form of an annular ring.

Another such system is disclosed by U.S. Pat. No. 7,300,115 to Holl et al., which describes a chisel holder for a road milling machine or the like, having a base element supporting a holding neck, a protrusion connected to the base element upstream of the holding neck when viewed in an advancing direction of the tool and a chip breaker formed on the base element and extending, starting at the holding neck, at least partially over the protrusion.

The prior art shows some advancements in increasing the wear resistance of degradation picks; however, it is believed that there is still a need to develop improved wear resistance apparatuses.

BRIEF SUMMARY OF THE INVENTION

In one aspect of the present invention, a body of a degradation pick may comprise a substantially conical frustum. A hammer element may be integrally formed with the substantially conical frustum and extend there from in one radial direction. A shank may protrude from the body opposite a narrow end of the substantially conical frustum.

The hammer element and the substantially conical frustum may be formed of the same material. In some embodiments, the shank may also be formed of the same material. These elements may be formed of the same material by casting them together. A super hard cutting element may be disposed on the narrow end of the substantially conical frustum.

In various embodiments, the wear resistance of the hammer element may be increased by disposing a hardfacing material on an exterior surface thereof or covering the exterior surface with a hard surface coating.

In some applications, the shank may be disposed within a hole of a block, wherein the block is attached to an exterior of a rotatable drum. In such situations, the hammer element may comprise an impact face generally parallel to a tangent of the rotatable drum. A front face may sit adjacent the impact face generally normal to the rotatable drum and facing in a direction of rotation of the rotatable drum. On either side of the impact face there may be side faces generally normal to the rotatable drum and facing in opposite directions axially along the rotatable drum.

In different embodiments, the impact face may form a substantially planar surface or rise up from the side faces to form a ridge extending from the front face to the substantially conical frustum. In the first incarnation, the two side faces may form generally right angles relative to the substantially planar surface. In the latter, a radius of curvature of the impact face at the ridge may be greater than 1.00 inch (25.4 mm) and form an angle between the ridge and the substantially conical frustum between 100 and 180 degrees. Also, the transition between the hammer element and the substantially conical frustum may be continuous and comprise a radius of curvature greater than 0.25 inches (6.35 mm).

In some embodiments, the substantially conical frustum comprises a tapered sidewall adjacent the narrow end and a constant sidewall adjacent an opposing broad end. Also, a cross-sectional area of the broad end may be at least 4 times as large as a cross-sectional area of the narrow end. A volume of the hammer element may be between 10 and 20% of a volume of the body. Further, the shank may be offset from a central axis of the substantially conical frustum by an angle between 15 and 25 degrees.

DETAILED DESCRIPTION OF THE INVENTION

Figure 1:
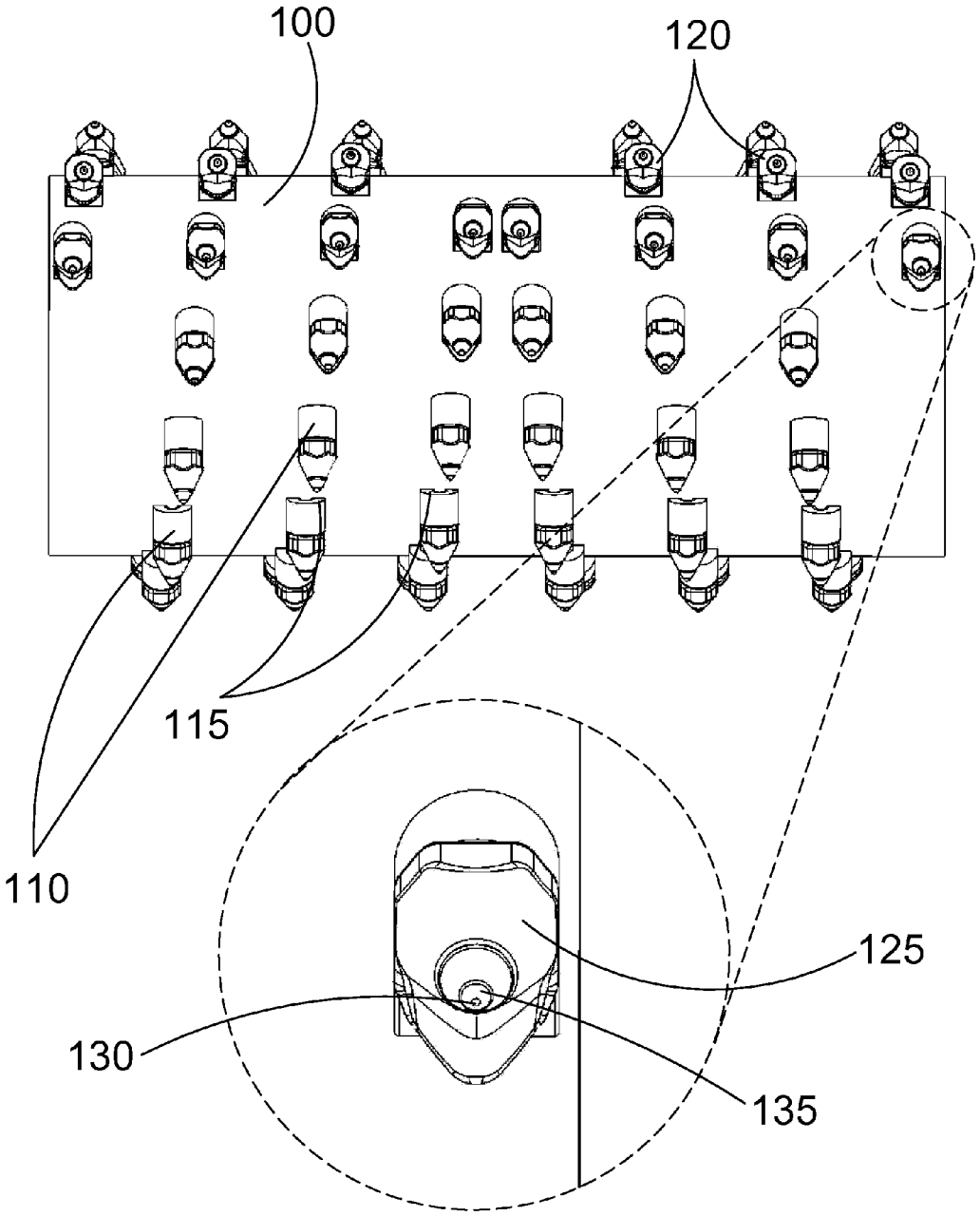
FIG. 1 is a magnified orthogonal view of an embodiment of a degradation pick of the present invention secured to the exterior of a rotatable drum.

Referring now to the figures, FIG. 1 discloses a front orthogonal view of an embodiment of a rotatable drum 100 such as may be used in road milling, mining or construction.

A plurality of blocks 110, each comprising a hole 115 therein, may be disposed around an exterior surface of the rotatable drum 100. A plurality of degradation picks 120, each comprising a body 125 comprising a pointed end 130 opposite a shank (hidden), may be secured to the plurality of blocks 110 by disposing each shank within a hole 115. The rotatable drum 100 may be rotated to bring a super hard tip 135 disposed on the pointed end 130 into contact with and degrade a surface. The body 125 may be made of steel and consequently wear at a faster rate than the super hard tip 135. This may prematurely limit the useful life of the degradation pick because significant wear may not have occurred at the super hard tip 135 when the steel is in need of replacement. To offset extensive wear to the body 125 and thus extend the useful life of the degradation pick, additional material may be added to the body in a direction of impact.

Figure 2:
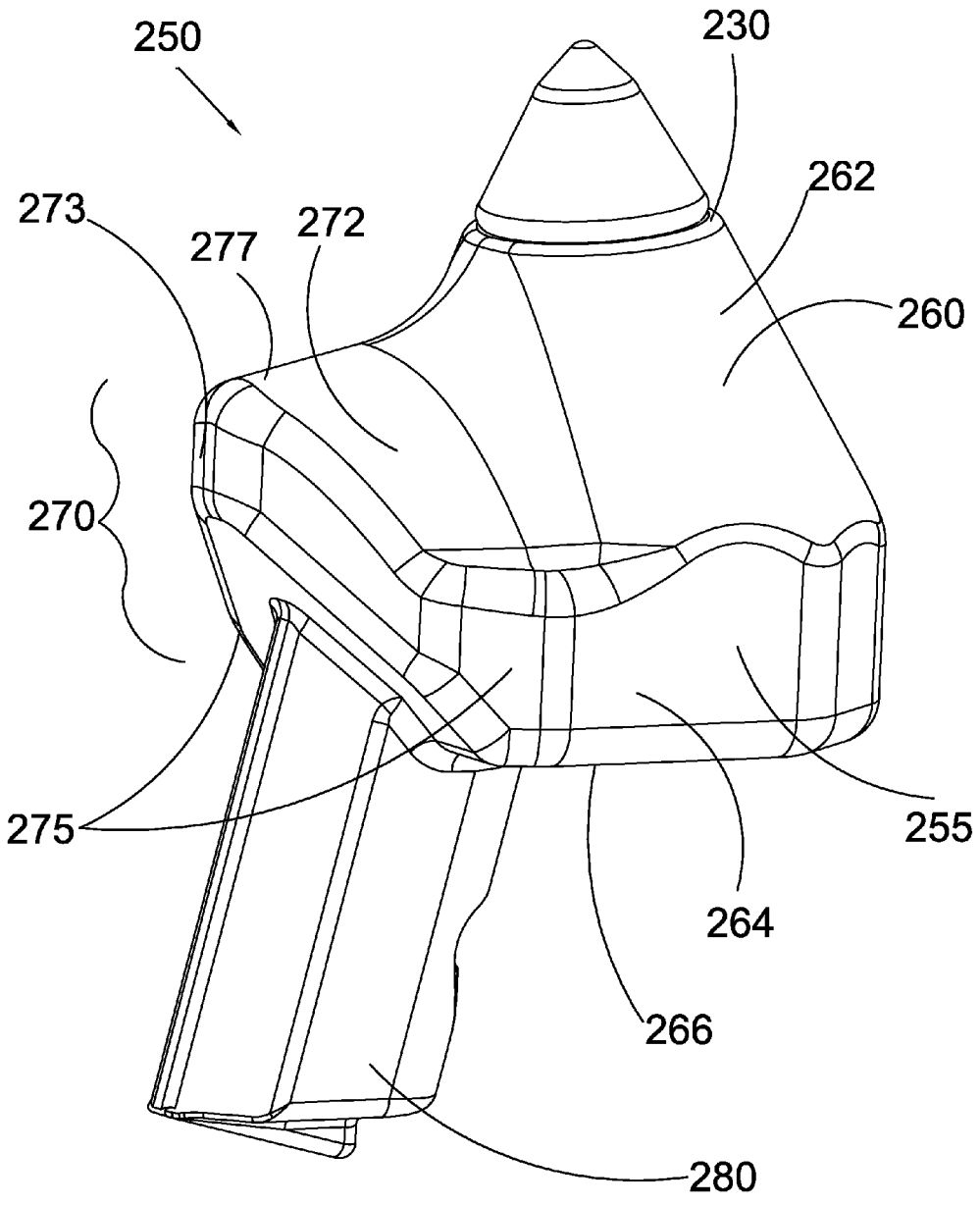
FIG. 2 is a perspective view of an embodiment of a degradation pick comprising a hammer rising to form a ridge extending from a front face to a substantially conical frustum.

FIG. 2 discloses an embodiment of a degradation pick 250 with a body 255 comprising a substantially conical frustum 260. A hammer element 270 may be integral with and extend from the substantially conical frustum 260 in one radial direction. It is believed that the life of the degradation pick 250 may be extended by pointing the radial direction of the hammer element 270 in the direction of impact. For example, with reference to FIG. 1, the direction of impact may be the direction of rotation of the rotatable drum 100.

The substantially conical frustum 260 may comprise a tapered sidewall 262 adjacent a narrow end 230 and a constant sidewall 264 adjacent an opposing broad end 266. The cross-sectional area of the broad end 266 may be at least 4 times as large as a cross-sectional area of the narrow end 230. Additionally, a volume of the hammer element 270 may be between 10 and 20% of a volume of the body 255. Further, a shank 280 may protrude from the body 255 opposite the narrow end 230 of the substantially conical frustum 260. As shown, the shank 280 may be offset from a central axis of the substantially conical frustum 260 by an angle between 15 and 25 degrees.

In the embodiment shown, the hammer element 270, substantially conical frustum 260 and shank 280 are formed of the same material. This may be accomplished by casting those elements together.

The embodiment of the hammer element 270, as shown in FIG. 2, comprises an impact face 272. The impact face 272 may be generally parallel to a tangent of the rotatable drum 100 (see FIG. 1). A front face 273 may be generally normal to the rotatable drum 100 and facing in a direction of rotation of the rotatable drum 100. First and second side faces 275 may be generally normal to the rotatable drum 100 and facing in opposite directions axially along the rotatable drum 100. The impact face 272 may rise from the first and second side faces 275 to form a ridge 277 extending from the front face 273 to the substantially conical frustum 260. A radius of curvature of the ridge 277 may be greater than 1.00 inch (25.4 mm). Further, the ridge 277 and the substantially conical frustum 260 may form an angle between 100 and 180 degrees. A continuous transition between the hammer element 270 and the substantially conical frustum 260 may comprise a radius of curvature greater than 0.25 inches (6.35 mm).

The wear resistance of the hammer element 270 may be increased by disposing a hardfacing material on an exterior surface thereof or covering the exterior surface with a hard surface coating.

Figure 3:
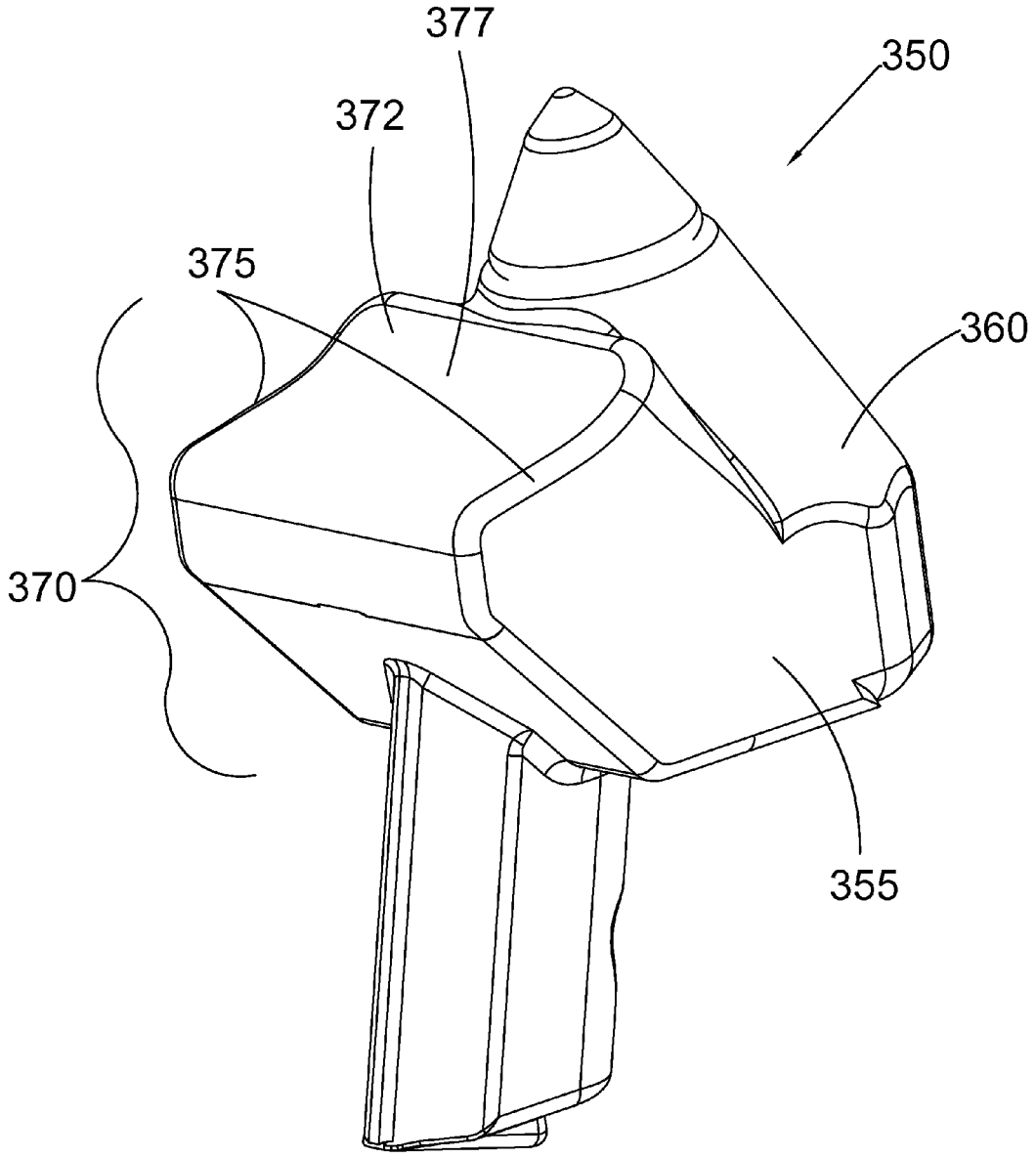
FIG. 3 is a perspective view of another embodiment of a degradation pick comprising a hammer forming a substantially planar surface.

FIG. 3 discloses another embodiment of a degradation pick 350 with a body 355 comprising a substantially conical frustum 360 and a hammer element 370 integral with and extending from the substantially conical frustum 360. In this embodiment, an impact face 372 of the hammer element 370 forms a substantially planar surface 377. In some embodiments, the substantially planar surface 377 forms generally right angles relative to first and second side faces 375.

Whereas the present invention has been described in particular relation to the drawings attached hereto, it should be understood that other and further modifications apart from those shown or suggested herein, may be made within the scope and spirit of the present invention.

What is claimed is:

1. A degradation pick, comprising:

a body comprising a hammer element integral with and extending from a substantially conical frustum in one radial direction;

a shank protruding from the body opposite a narrow end of the substantially conical frustum;

a super hard cutting element disposed on the narrow end of the substantially conical frustum; and a block attached to an exterior of a rotatable drum, wherein the shank is disposed within a hole in the block;

wherein the hammer element comprises an impact face generally parallel to a tangent of the rotatable drum; a front face generally normal to the rotatable drum and facing in a direction of rotation of the rotatable drum; and first and second side faces generally normal to the rotatable drum and facing in opposite directions axially along the rotatable drum;

wherein the impact face rises from the first and second side faces to form a ridge extending from the front face to the substantially conical frustum.

2. The degradation pick of claim 1, wherein the hammer element and substantially conical frustum are formed of the same material.

3. The degradation pick of claim 1, wherein hardfacing material is disposed on an exterior surface of the hammer element.

4. The degradation pick of claim 1, wherein an exterior surface of the hammer element is covered with a hard surface coating.

5. The degradation pick of claim 1, wherein a radius of curvature of the impact face at the ridge is greater than 1.00 inch (25.4 mm).

6. The degradation pick of claim 1, wherein an angle between the ridge and a tapered sidewall of the substantially conical frustum is between 100 and 180 degrees.

7. The degradation pick of claim 1, further comprising a continuous transition between the hammer element and the substantially conical frustum.

8. The degradation pick of claim 7, wherein the continuous transition comprises a radius of curvature greater than 0.25 inches (6.35 mm).

9. The degradation pick of claim 1, wherein the substantially conical frustum comprises a tapered sidewall adjacent the narrow end and a constant sidewall adjacent an opposing broad end.

10. The degradation pick of claim 9, wherein a cross-sectional area of the broad end is at least 4 times as large as a cross-sectional area of the narrow end.

11. The degradation pick of claim 1, wherein a volume of the hammer element is between 10 and 20% of a volume of the body.

12. The degradation pick of claim 1, wherein the shank is offset from a central axis of the substantially conical frustum by an angle between 15 and 25 degrees.

13. The degradation pick of claim 1, wherein the hammer element, substantially conical frustum, and shank are formed of the same material.

14. The degradation pick of claim 1, wherein the hammer element, substantially conical frustum, and shank are cast together.

* * * * *